United States Patent [19]

Hager

[11] 4,366,627

[45] Jan. 4, 1983

[54] PROCESS FOR THE TREATMENT OF WOOD

[76] Inventor: Bror O. Hager, Forsetevagen 5, S-182 63 Djursholm, Sweden

[21] Appl. No.: 252,233

[22] Filed: Apr. 8, 1981

[51] Int. Cl.[3] ..... F26B 3/00; F26B 5/04; D05B 3/12

[52] U.S. Cl. ..... 34/9.5; 8/402; 34/13.8; 34/16.5; 106/265

[58] Field of Search ..... 34/9.5, 13.4, 13.8, 34/16.5; 106/265; 8/402

[56] References Cited

U.S. PATENT DOCUMENTS

| | | | |
|---|---|---|---|
| 2,860,070 | 11/1958 | McDonald | 34/9.5 |
| 3,086,871 | 4/1963 | Sheldahl et al. | 106/265 |
| 3,707,387 | 12/1972 | Enomoto et al. | 106/265 |
| 3,995,077 | 11/1976 | Hager | 34/138 |

FOREIGN PATENT DOCUMENTS

| | | |
|---|---|---|
| 210542 | 1/1967 | Sweden . |
| 393676 | 5/1977 | Sweden . |
| 1512549 | 6/1978 | United Kingdom . |
| 1516145 | 6/1978 | United Kingdom . |

*Primary Examiner*—John J. Camby

*Attorney, Agent, or Firm*—Burns, Doane, Swecker & Mathis

[57] ABSTRACT

A process for the treatment of wood is disclosed wherein the wood is contacted with an oil mixture in order to dry/color the wood. The mixture comprises both low and high boiling oils.

16 Claims, No Drawings

PROCESS FOR THE TREATMENT OF WOOD

BACKGROUND OF THE INVENTION

The present invention is directed to an improved method for the treatment of wood.

Many processes are known for the treatment of wood. For example, U.S. Pat. No. 3,560,251 (issued to Hager) discloses the preservation of wood with aqueous solutions followed by drying/coloring of the wood in a heated high-boiling oil under vacuum. U.S. Pat. No. 3,995,077 (issued to Hager) discloses a process where the wood is impregnated with preservation agents contained in an organic solvent followed by the drying/coloring of the wood in hot oil with simultaneous recovery of solvent. U.S. Pat. No. 4,305,978, issued from application Ser. No. 125,774, filed Feb. 29, 1980 (of Hager) discloses wood preservation with an emulsion followed by drying/coloring of the wood in hot oil. In addition, U.S. Pat. No. 3,811,200 (issued to Hager) discloses a process wherein wet (green) wood is dried in a low boiling oil. Swedish patent application Ser. No. 8,007,480-0 filed on Oct. 24, 1980 and laid open for public inspection on Apr. 24, 1982 also discloses a process for the drying/coloring of moist or moistened wood.

DETAILED DESCRIPTION OF THE INVENTION

The process for the treatment of wood of the present invention is carried out in a manner similar to the processes disclosed in the previously—described prior art processes. That is, similar conditions of temperature and pressure are employed. The improvement in the present invention is the fact that the drying-coloring oil is comprised of a mixture of high boiling and low boiling oils.

During the treatment of wood by the process of the present invention, the wood is contacted with a mixture comprising both low and high boiling oils. During such contacting, a portion of the oil mixture (including both low and high boiling oils) together with any ingredients (e.g., coloring pigments) contained therein penetrates the surface layer of the wood. At the same time and as a result of the temperatures and pressures employed, a portion of the low boiling oils, free of ingredients, evaporates from the oil mixture together with any water or solvent originally present in the wood which also evaporates from the wood. The oil mixture which remains is thereafter removed from contact with the wood. The wood is thereafter maintained under a vacuum to cause any low boiling oils which remain upon removal of the mixture to evaporate from the wood. A portion of the high boiling oils will ultimately remain in the surface of the wood and provide the wood with color, surface protection, etc. The evaporated low boiling oil (and possibly solvents or water) which is boiled away from the wood may be recovered from the mixture by condensation. The lower boiling oils can be separated from the water or solvents and recovered.

The dilution of the high boiling oils by inclusion of low boiling oils enables the amount of high boiling oils which is absorbed by the wood to be controlled. For example, in the drying/coloring of wood, an amount of 40–60 kilograms of coloring oil per cubic meter is often absorbed for boards having a thickness of about 25 millimeters. This amount is, as a rule, more than adequate and is several times higher than the amount of oil generally absorbed by painting the wood with the preservative. By diluting the high boiling oils with lower boiling oils (which, contrary to conventional painting processes, are ultimately recovered) the amount of coloring oil (i.e., high boiling oil) absorbed by the wood can be controlled and/or lessened. This involves also, due to a lower consumption of high boiling oils, the production of a product of high quality. Another advantage of the present invention is that the ability to use more viscous vehicles such as alkyds and additives such as waxes and resins is enhanced due to the presence of the low boiling oils which serve to lower the viscosity of the oil mixture and enable the mixture to be more easily handled and contacted with the wood.

For the purposes of the present invention, suitable low boiling oils possess boiling points ranging from about 150° to about 250° C. and preferably between about 175° and about 200° C. These oils are, of course, not miscible with water.

Such low boiling oils are preferably comprised of petroleum products having a low content of aromatic compounds in order to avoid the leaching out of resins and other materials from the wood. Exemplary low boiling oils include but are not limited to a petroleum product marketed under the tradename "Shellsol T" which boils between about 187° C. and 212° C., has a flash point of 55° C., and is free of aromatics. See also U.S. Pat. No. 3,811,200, herein incorporated by reference, for a further discussion of low boiling oils suitable to use in the present invention.

The high boiling oils can be constituted of many different oils boiling preferably over 350° C.

Practically all non drying common oils can be used. It is an advantage if they have a light color and no disturbing smell. In most cases oils of paraffin type have been used. Many different types of drying oils can be used as for instance linseed, rape, and soy oil. Very suitable oils are some esthers of tall oil. Different alkydes can also be used.

For obtaining a non oily wood surface and having the pigment in the oil fixed on the wood it is as a rule necessary to have at least 50 percent of drying oils in the high boiling oil mixture. The high boiling oils thus contain as a rule 50 to 100 percent drying oils.

Suitable high boiling oils possess boiling points ranging from about 300° C. to about 400° C., and preferably in excess of about 350° C. A further discussion of suitable high boiling point oils is present in Swedish patent application Ser. No. 7,908,379-6 filed on Oct. 10, 1979 and laid open for public inspection on Apr. 10, 1981.

The proportions of high and low boiling oils which can be employed can vary within wide limits. However, a major benefit of the invention is the ability to conserve considerable amounts of the high boiling oils which would otherwise be used. The content of the high boiling oil in the mixture should thus not be too high for reasons of economics. As a rule, the amount of the high boiling oil which is employed ranges from about 50 to about 25 volume percent of the oil mixture, and most preferably comprises less than about 50 percent by volume of the oil mixture. Preferably, at least about 25 volume percent of the high boiling oil will always be present in the mixture in order to ensure that the desired results are achieved. A suitable volume ratio of high boiling oil to low boiling oil is about 50:50 to about 25:75.

The oil mixture can contain various additive substances in order to impart desirable characteristics to the wood during the contacting step. For example, the addition of waxes or resins will serve to impart water repellancy to the wood. The use of conventional fire-protective substances such as chloroparaffin can also be desirably dissolved in the oil mixture. Suitable pigmenting or coloring substances can be introduced into the oil to ensure that the wood will become colored during the course of the drying step. Such additives are conventional and well-known to those skilled in the art.

If coloring pigments are employed, the amount of high boiling oils is preferably not too low. As a rule, the mixture will then generally comprise at least 25 volume percent of high boiling oils. If the content of high boiling oils is too low, it may be difficult to ensure that the pigments are adequately dispersed. Stirring facilitates, however, the dispersion of the pigments within the oil. If the intention is to obtain an oil treatment of the wood surface without coloring, the content of high boiling oils can be reduced while the content of low boiling oils can be increased. Even if it, in these cases, is more difficult to introduce pigments in the oils, it is still possible to introduce dissolved substances such as wax, and preservatives against decay, blue stain, mould and insects etc.

The method of operation and conditions of temperature and pressure which can be employed during the drying/coloring step are readily determined by one skilled in the art. For example, the wood to be treated is placed in a treatment cylinder adapted to be closed to the atmosphere. The wood is then contacted with a suitable oil mixture comprising a mixture of low and high boiling oils which is heated to a suitable temperature. For example, the oil mixture is generally heated to about 60° to about 90° C., and preferably heated to about 80° C.

In addition, a vacuum is maintained within the treatment cylinder to facilitate removal of moisture or solvents from the wood so as to avoid the need to employ high temperatures in the treatment cylinder. Water and accompanying drying oil and/or solvents which evaporates or boils off is recovered and subjected to condensation to separate the components of the mixture which is recovered. The drying oil may then be recycled.

The vacuum should desirably be sufficiently high to enable the water to boil off energetically but not so high that such boiling occurs too rapidly. The higher the overall boiling point of the drying oil mixture employed, the higher the vacuum employed can be. A suitable vacuum will generally range from about 60 to about 85 percent.

After the wood has been sufficiently dried by removal of moisture and/or solvents contained therein, the oil mixture is removed from the cylinder while the vacuum is maintained. This enables the residual drying oil mixture to evaporate from the wood while no further heat is imparted to the wood.

By the treatment of the present invention, the oil is removed from the wood surface by this vacuum treatment after the drying step. This can be achieved because the low boiling oil has a boiling point of about 250° C. or lower. However, it is desirable for the boiling point for the lower boiling oils to be below about 200° C. because the presence of the high boiling oils can hinder the evaporation of the lower boiling oils. If the content of high boiling oils is comparatively high, the lower boiling oils desirably boil below about 175° C. If the content of high boiling oils is relatively low, the boiling point of the lower boiling oils should desirably approach about 200° C. The high boiling oils preferably boil at about or in excess of 350° C.

The process can be fulfilled with oil mixtures with less distinct boiling ranges between the high and the low boiling oils. It can even be carried out with an oil mixture with no distinct ranges that is a mixture that successively boils over a wide temperature range. However, it is preferable for the difference between the boiling points of the low and high boiling oils to be distinct.

The process of the present invention may be used to dry/color several types of wood. That is, the wood may have been pretreated with a preservative solution (e.g., an aqueous preservative solution or an organic solvent-containing preservative solution). After the preservative solution has contacted the wood for a sufficient period of time, it is removed from the wood and subsequently contacted with the drying/coloring oil mixture of the present invention to remove the water or solvent from the wood and possibly also color the wood.

In addition, wood which has not been treated with a preservative solution but which it is desired to remove moisture from (e.g., green or wet wood) can be dried by contact with the oil mixture of the present invention. The wood is contacted with the oil mixture under suitable conditions of temperature and pressure to cause the moisture present in the wood to evaporate from the wood.

Exemplary processes wherein either wet or green wood or wood which has been pretreated with a preservative solution have been dried and/or colored by contact with an oil mixture are described in U.S. Pat. Nos. 3,811,200 and 3,560,251, each herein incorporated by reference.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

I claim:

1. A method for drying products of wood which comprises heating wood which is to be dried in a closed container under reduced pressure in a heated drying medium comprising a mixture of high boiling and low boiling oils in a volume ratio of high boiling to low boiling oils of about 50:50 to 25:75 with said high boiling oil being present in an amount of at least about 25 volume percent, said wood being heated and said pressure being reduced sufficiently to cause moisture to be removed from said wood, said high boiling oils having a boiling point ranging from about 300° to about 425° C. and said low boiling oils having a boiling point ranging from about 150° to about 225° C., and removing said drying medium from contact with said wood upon removal of the desired amount of moisture from the wood while said wood is maintained under reduced pressure which reduced pressure is maintained to remove said low boiling oil from the wood by evaporation.

2. The method of claim 1 wherein said low boiling oil boils from about 150° to about 200° C.

3. The method of claim 1 wherein said low boiling oil boils below about 200° C.

4. The method of claim 1 wherein said high boiling oil boils from about 325° to about 400° C.

5. The method of claim 1 wherein said high boiling oil boils in excess of about 350° C.

6. The method of claim 1 wherein said wood drying oil mixture contains about 50 to about 25 volume percent of high boiling oils.

7. The method of claim 1 wherein said drying oil mixture contains less then about 50 percent by volume of high boiling oils.

8. The method of claim 1 wherein said wood is heated from about 60° to about 90° C.

9. The method of claim 8 wherein said wood is heated to about 80° C.

10. The method of claim 1 wherein said high and low boiling oils are petroleum products.

11. The high boiling oils of claim 1 contain 50 to 100 percent drying oils.

12. A novel oil mixture for use in the drying of wood comprising a mixture of high boiling and low boiling oils in a volume ratio of 50:50 to 25:75 with said high boiling oil being present in an amount of at least 25 volume percent, said high boiling oils having a boiling point ranging from about 325° to about 400° C. and said low boiling oils having a boiling point ranging from about 150° to about 200° C.

13. The oil mixture of claim 12 wherein said low boiling oil boils below about 200° C.

14. The oil mixture of claim 12 wherein said high boiling oil boils above about 350° C.

15. The oil mixture of claim 12 wherein said high boiling oil comprises less than about 50 volume percent of the mixture.

16. The oil mixture of claim 12 wherein said high boiling oil comprises in excess of about 25 volume percent of the mixture.

* * * * *